US009038303B1

(12) United States Patent
Olson

(10) Patent No.: US 9,038,303 B1
(45) Date of Patent: May 26, 2015

(54) REPEATING CONE-BREECH FIREARM SYSTEM

(75) Inventor: Clifford W. Olson, Easton, CT (US)

(73) Assignee: Innovative Tool and Advanced Weapon Solutions, LLC, Easton, CT (US)

( * ) Notice: Subject to any disclaimer, the term of this patent is extended or adjusted under 35 U.S.C. 154(b) by 0 days.

(21) Appl. No.: 13/548,171

(22) Filed: Jul. 12, 2012

Related U.S. Application Data

(60) Provisional application No. 61/572,475, filed on Jul. 18, 2011.

(51) Int. Cl.

| | |
|---|---|
| ***F41A 15/08*** | (2006.01) |
| ***F41A 3/12*** | (2006.01) |
| ***F41A 9/00*** | (2006.01) |
| ***F41A 15/12*** | (2006.01) |

(52) U.S. Cl.
CPC ... *F41A 3/12* (2013.01); *F41A 9/00* (2013.01); *F41A 15/12* (2013.01); *F41A 15/08* (2013.01)

(58) Field of Classification Search
CPC ..... F41A 15/12; F41A 15/14
USPC ..... 42/25; 89/197
See application file for complete search history.

(56) References Cited

U.S. PATENT DOCUMENTS

| | | | | |
|---|---|---|---|---|
| 467,180 | A | 1/1892 | Mauser | |
| 2,198,610 | A | 4/1940 | Garand | |
| 3,253,362 | A * | 5/1966 | Gitchell | 42/16 |
| 3,411,405 | A * | 11/1968 | Pachmayr et al. | 89/196 |
| 3,780,618 | A | 12/1973 | Sanford | |
| 4,269,108 | A * | 5/1981 | Stoner | 89/33.01 |
| 4,272,902 | A | 6/1981 | Waters | |
| 5,351,598 | A | 10/1994 | Schuetz | |
| 5,520,019 | A | 5/1996 | Schuetz | |
| 5,794,373 | A | 8/1998 | Moon | |
| 6,182,389 | B1 | 2/2001 | Lewis | |
| 6,609,319 | B1 | 8/2003 | Olson | |
| 7,735,410 | B2 | 6/2010 | Clark | |
| D641,451 | S | 7/2011 | Gomez et al. | |
| 8,087,194 | B1 | 1/2012 | Vuksanovich | |
| 8,161,864 | B1 | 4/2012 | Vuksanovich | |
| 8,307,750 | B2 | 11/2012 | Vuksanovich et al. | |
| 8,387,513 | B2 | 3/2013 | Gomez et al. | |
| 2002/0073591 | A1 | 6/2002 | Schweikart | |
| 2006/0185212 | A1 | 8/2006 | Curry et al. | |

FOREIGN PATENT DOCUMENTS

| | | |
|---|---|---|
| DE | 30 38 769 | * 12/1988 |
| EP | 0 190 456 | 5/1988 |

OTHER PUBLICATIONS

Notice of Allowance for U.S. Appl. No. 13/548,168 filed Jul. 12, 2012 dated Oct. 28, 2014; 5 pp.

* cited by examiner

*Primary Examiner* — Stephen M Johnson
(74) *Attorney, Agent, or Firm* — Fincham Downs, LLC; Carson C.K. Fincham

(57) ABSTRACT

Systems, methods, and articles of manufacture for repeating cone-breech firearm systems are provided. A cone-breech firearm system may, for example, comprise a tapered bolt having a cartridge channel that facilitates engagement of an ammunition cartridge with a cartridge seat and/or a plunger-style ejector.

9 Claims, 5 Drawing Sheets

REPEATING CONE-BREECH FIREARM SYSTEM

CROSS-REFERENCE TO RELATED APPLICATIONS

The present application is a non-provisional of, and claims benefit and priority under 35 U.S.C. §119(e) to, U.S. Provisional Patent Application No. 61/572,475 filed on Jul. 18, 2011 and titled "REPEATING CONE BREACH CARTRIDGE FEEDING SYSTEM", the entirety of which is hereby incorporated by reference herein.

BACKGROUND

Most firearms utilize a bolt with a planar face that is designed to mate with a corresponding planar face of a breech or firing chamber (e.g., to seal a cartridge in the chamber for firing). It is understood however, that a tapered or cone-shaped mating configuration is advantageous. Tapering the face of the bolt and providing a cone-shaped breech, for example, provides a less obstructive path for feeding cartridges into the firing chamber and/or provides for an increased surface contact mating area between the bolt and the breech. These advantages allow for (i) more reliable cartridge feeding (e.g., less jamming and/or cartridge damage upon feeding) and (ii) increased contact area provides an enhanced seal that is less likely to result in blowback or structural failure, respectively.

Different types and/or styles of cartridge ejection mechanisms or "ejectors" are utilized in various types of firearms. Some are integral to the firearm bolt (e.g., a "plunger-style" ejector) while others are integral to the receiver assembly. While each available style provides differing benefits and drawbacks, many prefer the simplicity and bolt-integral nature and operating characteristics of the plunger-style ejector.

Despite these recognized advantages, most firearms do not utilize a cone-shaped breech. This is primarily due to the fact that tapered bolt configurations capable of use in cone-shaped breech systems are not capable of functioning properly in repeating firearms, particularly in conjunction with a plunger-style ejector. In other words, magazine and clip-feed firearms that are designed to store and repeatedly load, fire, and eject cartridges in a repeating fashion are unable to benefit from the advantages of a cone-breech design, especially when combined with a plunger-style ejector, due to interference with cartridge loading.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

Embodiments presented herein are descriptive of systems, apparatus, methods, and articles of manufacture for a repeating cone-breech firearm system. In some embodiments, for example, an engaging face of a tapered firearm bolt comprises a cartridge guide cut (and/or otherwise formed) therein, the cartridge guide permitting a cartridge in a repeating firearm system to be successfully seated in the bolt and loaded into the chamber of a cone-breech system. In some embodiments, the cartridge guide permits utilization of a plunger-style ejector in the cone-breech firearm system. According to some embodiments, the plunger-style ejector may be rounded and/or chamfered.

Figure 1:
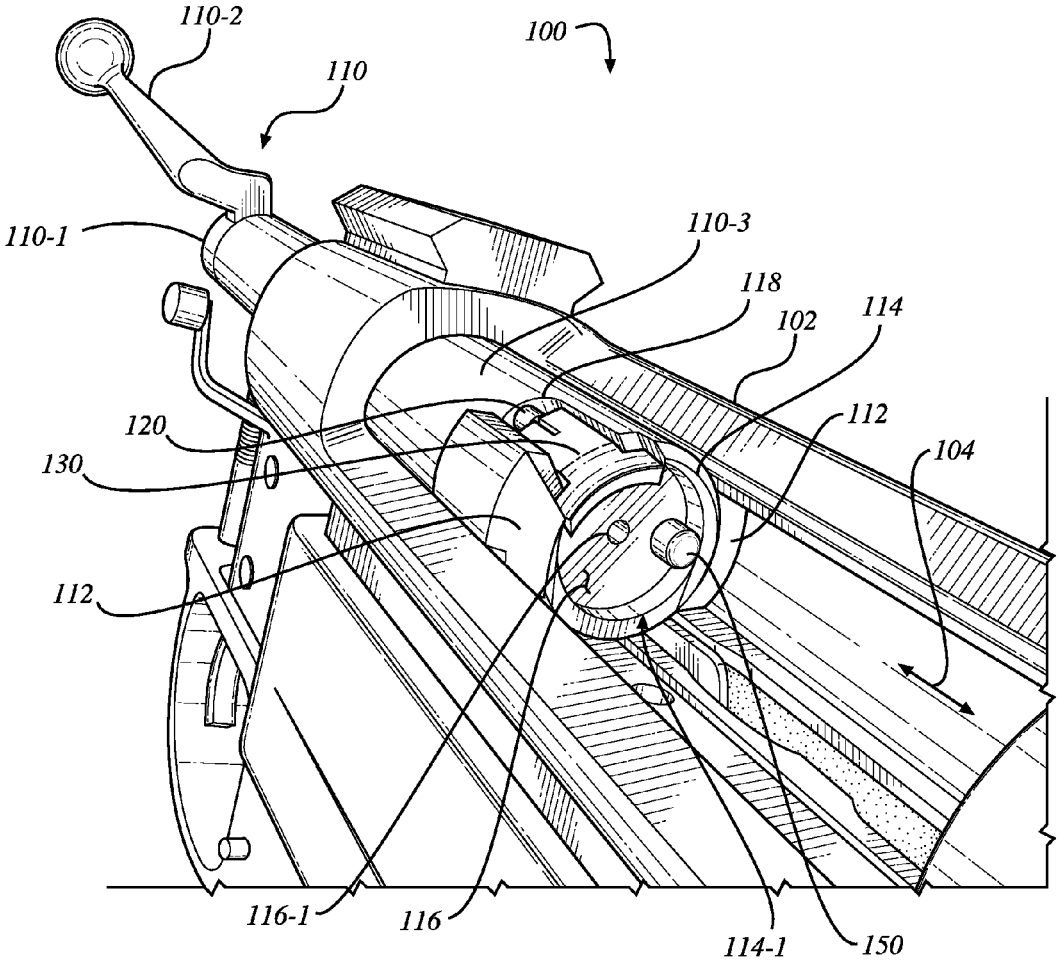
FIG. 1 is a perspective diagram of a firearm system according to some embodiments.
Figure 2A:
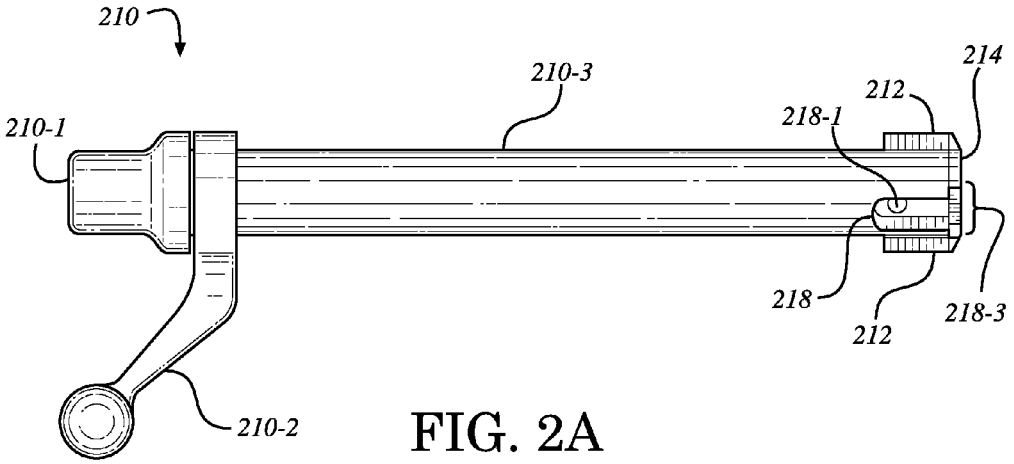
FIG. 2A, FIG. 2B, FIG. 2C, and FIG. 2D are side, top, front, and rear views of a firearm bolt assembly according to some embodiments.
Figure 2B:
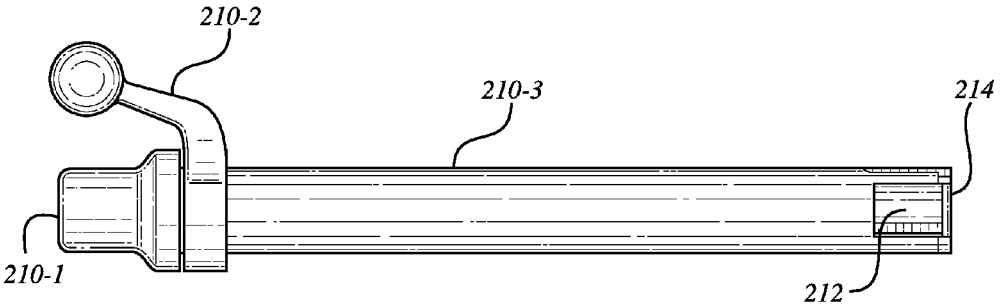
Figure 2C:
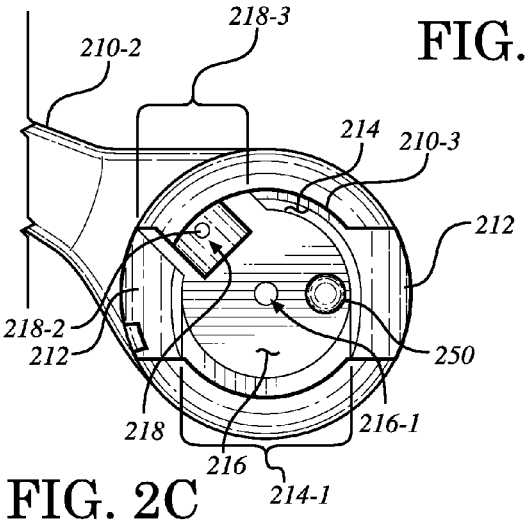
Figure 2D:
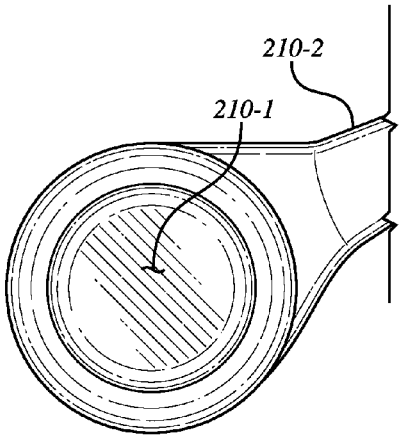

Turning first to FIG. 1, for example, a perspective diagram of a firearm system 100 according to some embodiments is shown. The firearm system 100 of FIG. 1 may, for example, comprise a non-limiting exemplary illustration of a portion of a bolt-action and/or repeating rifle (and/or other firearm, cannon, artillery, etc.). In some embodiments, the firearm system 100 may comprise a receiver assembly 102 having an opening cut and/or cavity formed therein (sometimes referred to as a "bolt way"), thereby defining an ejection port 104. In some embodiments, disposed within the cavity comprising the ejection port 104 may be a bolt assembly 110 comprising an end collar 110-1, a bolt handle 110-2, and/or a bolt body 110-3. In some embodiments, the bolt assembly 110 may comprise locking lugs 112 that are configured to engage with the receiver assembly 102 and/or the side-walls of the ejection port 104. The bolt assembly 110 may, in some embodiments, comprise an engaging face 114 (comprising a cartridge guide 114-1) and a cartridge seat 116 recessed from the engaging face 114 and/or configured to receive the rear of an ammunition cartridge (not shown in FIG. 1).

According to some embodiments, the cartridge seat 116 (and/or the bolt assembly 110) may comprise a firing pin hole 116-1 through which an internal firing pin assembly (or a portion thereof, such as a firing pin; none of which are depicted in FIG. 1) may protrude to forcibly ignite primer in an ammunition cartridge seated in the cartridge seat 116. As depicted for non-limiting purposes of illustration only, the firearm bolt assembly 110 comprises a center-fire bolt assembly. The bolt assembly 110, according to some embodiments, may be configured to rotatably traverse through the ejection port 104 such that the locking lugs 112, disposed within locking-lug recesses/channels/"ways" (not explicitly depicted in FIG. 1) couple the bolt assembly 110 to the receiver assembly 102. The bolt assembly 110 may, in some embodiments, be configured such that upon a full traversal of the ejection port 104, the engaging face 114 engages with a breech or chamber end wall (neither of which are shown in FIG. 1), securely coupling a seated cartridge into the breech and/or chamber of the firearm system 100, and closing-off or sealing the ejection port 104. As depicted in FIG. 1, the engaging face 114 of the bolt assembly 110 is tapered or "cone-shaped" to mate with a corresponding cone-shaped breech configured to receive the engaging face 114.

In some embodiments, the bolt assembly 110 may comprise an extractor channel 118 cut and/or formed in the side of the bolt assembly 110. According to some embodiments, disposed within the extractor channel 118 may be an extractor plunger 120 engaged with an extractor 130. The extractor plunger 120 may be acted upon by an extractor spring (not shown in FIG. 1) disposed within the bolt assembly 110 and/or the extractor channel 118 thereof. The extractor plunger 120 may, in some embodiments (e.g., due to such a spring and/or other device), exert a force upon the extractor

130 such that a rim on the rear of a cartridge forcibly engages with and becomes coupled to the extractor 130 upon being seated in the cartridge seat 116. The engaging and/or coupling of the extractor 130 with the cartridge may, for example, allow (and/or facilitate) the cartridge to be removed from the breech and/or chamber as the bolt assembly 110 is disengaged to traverse the ejection port 104 in the opposite direction, opening and/or un-sealing the ejection port 104. While the extractor 130 depicted in FIG. 1 comprises a modified Sako®-style extractor (e.g., a particular version of a "wide-flanged extractor" as described in U.S. patent application Ser. No. 13/548,168, titled "WIDE-FLANGED CARTRIDGE EXTRACTOR" and filed in the name of OLSON on Jul. 12, 2012, the "wide-flanged extractor" concepts and descriptions of which are hereby incorporated by reference herein), other types and/or configurations of extractors 130 may be utilized without deviating from the scope of embodiments herein.

According to some embodiments, the firearm system 100 may comprise an ejector 150. Although different styles and configurations of ejectors 150 may be utilized, a plunger-style ejector 150 is depicted in FIG. 1 for non-limiting illustration purposes. As shown, the plunger-style ejector 150 may be disposed within the bolt assembly 110 and/or within the recessed cartridge seat 116. The plunger-style ejector 150 may, in some embodiments, be acted upon by a spring (not shown) within the bolt assembly 110 that allows and/or causes the plunger-style ejector 150 to exert force upon the rear of a cartridge seated in the cartridge seat 116. As the bolt assembly 110 is disengaged to traverse through the ejection port 104 and away from the breech (e.g., after a cartridge is utilized to fire a projectile from the firearm, or otherwise), the force exerted by the plunger-style ejector 150 upon the cartridge may, for example, cause the spent cartridge to be ejected from the receiver assembly 102 and/or the cavity comprising the ejection port 104. A new cartridge may then enter the cavity comprising the ejection port 104 and become seated in the cartridge seat 116 and engaged with the extractor 130, such that the process may be repeated (e.g., another projectile may be fired after being loaded into the breech and/or chamber be engaging the bolt assembly 110). In repeating firearm systems, the new cartridge may automatically load into the cavity comprising the ejection port 104 and/or may become automatically seated within the cartridge seat 116 and engaged with the extractor 130 (e.g., from the floor of the ejection port 104 and/or otherwise from a magazine and/or clip (not explicitly shown in FIG. 1) coupled to the receiver assembly 102. In some embodiments (such as depicted in FIG. 1), the new cartridge may be guided into the cartridge seat 116 by and/or via the cartridge guide 116-1.

According to some embodiments, any or all of the components 110, 110-1, 110-2, 110-3, 112, 114, 114-1, 116, 116-1, 118, 120, 130, 150 of the firearm system 100 may be similar in configuration and/or functionality to any similarly named and/or numbered components described herein. Fewer or more components 110, 110-1, 110-2, 110-3, 112, 114, 114-1, 116, 116-1, 118, 120, 130, 150 (and/or portions thereof) and/or various configurations of the components 110, 110-1, 110-2, 110-3, 112, 114, 114-1, 116, 116-1, 118, 120, 130, 150 may be included in the firearm system 100 without deviating from the scope of embodiments described herein. In some embodiments, one or more of the various components 110, 110-1, 110-2, 110-3, 112, 114, 114-1, 116, 116-1, 118, 120, 130, 150 may not be needed and/or desired in the firearm system 100.

Referring now to FIG. 2A, FIG. 2B, FIG. 2C, and FIG. 2D, side, top, front, and rear views of a firearm bolt assembly 210 according to some embodiments are shown. In some embodiments, the firearm bolt assembly 210 may comprise an end collar 210-1, a bolt handle 210-2, and/or a bolt body 210-3. Although not visible in FIG. 2A, FIG. 2B, FIG. 2C, and FIG. 2D, the end collar 210-1 may retain a firing pin assembly within the bolt body 210-3. In some embodiments, the firearm bolt assembly 210 may comprise locking lugs 212, a breech face 214, a cartridge guide 214-1, and/or a cartridge seat 216. According to some embodiments, the cartridge seat 216 may comprise a firing pin hole 216-1 through which the internal firing pin assembly (or a portion thereof, such as a firing pin) may protrude to forcibly ignite primer in a cartridge (not shown) seated in the cartridge seat 216. As depicted for non-limiting purposes of illustration only, the firearm bolt assembly 210 comprises a center-fire bolt assembly.

In some embodiments, the firearm bolt assembly 210 may comprise an extractor channel 218. According to some embodiments, the extractor channel 218 may comprise a seat 218-1, a hole 218-2, and/or a wide-flange extractor cut 218-3. The seat 218-1 may be configured to accept a protrusion from a Sako®-style extractor and/or AR-15/M-16-style extractor (not shown), for example, and/or in the case of an AR-15/M-16-style extractor, an extractor spring (also not shown). In the case of a Sako®-style extractor, the hole 218-2 may be cut into the end of the extractor channel 218 as depicted and may be configured to accept an extractor plunger and/or an extractor spring (neither of which is shown). In the case of an AR-15/M-16-style extractor, the hole 218-2 may be instead cut into one or more of the sides of the extractor channel 218 and/or may accept a pin (not shown) that rotatably attaches the AR-15/M-16-style extractor. In some embodiments, the firearm bolt assembly 210 may comprise an ejector hole 250 configured to receive and/or accept a plunger-style ejector and/or ejector spring or mechanism (neither of which are shown).

In some embodiments, the cartridge guide 214-1 may comprise a cut, channel, and/or other formation and/or feature of the breech face 214. In such a manner, for example, the firearm bolt assembly 210 may be specially-configured to permit and/or facilitate repeated and/or automatic loading of a cartridge (not shown) into the cartridge seat 216. According to some embodiments (as depicted), the breech face 214 may be cone-shaped and/or tapered or chamfered. In some embodiments, a method may comprise machining, manufacturing, and/or modifying the firearm bolt assembly 210 to include the cartridge guide 214-1. A first cut may be made to form and/or define the cone-shape of the breech face 214, for example, and a second cut may be made to form and/or define the cartridge guide 214-1 (e.g., in and/or through the breech face 214). In some embodiments, a computer-readable medium may store specially-programmed instructions that when executed by a processing device (such as a processing device of a Computer Numerical Control (CNC) machine and/or machine tool) result in the performance of the method and/or in the creation of the cartridge guide 214-1. In some embodiments, such instructions may be stored on a computer-readable memory, which is defined herein as a subset of computer readable media that does not include transitory media types.

According to some embodiments, any or all of the components 210-1, 210-2, 210-3, 212, 214, 214-1, 216, 216-1, 218, 218-1, 718-2, 218-3, 250 of the firearm bolt assembly 210 (and/or the firearm bolt assembly 210 itself) may be similar in configuration and/or functionality to any similarly named and/or numbered components described herein. Fewer or more components 210-1, 210-2, 210-3, 212, 214, 214-1, 216, 216-1, 218, 218-1, 718-2, 218-3, 250 (and/or portions thereof) and/or various configurations of the components

210-1, 210-2, 210-3, 212, 214, 214-1, 216, 216-1, 218, 218-1, 718-2, 218-3, 250 may be included in the firearm bolt assembly 210 without deviating from the scope of embodiments described herein. In some embodiments, one or more of the various components 210-1, 210-2, 210-3, 212, 214, 214-1, 216, 216-1, 218, 218-1, 718-2, 218-3, 250 may not be needed and/or desired in the firearm bolt assembly 210.

Figure 3:
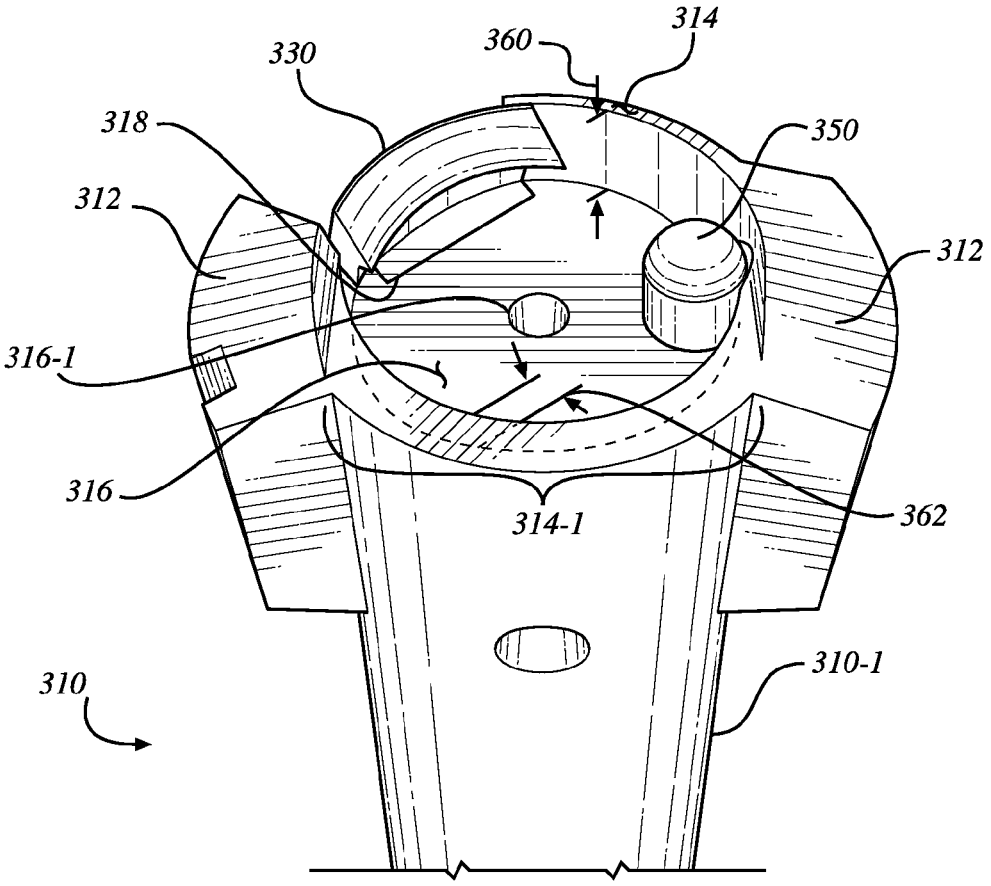
FIG. 3 is a perspective diagram of a portion of a firearm bolt assembly according to some embodiments.

Turning to FIG. 3, a perspective diagram of a portion of a firearm bolt assembly 310 according to some embodiments is shown. The firearm bolt assembly 310 may comprise, for example, a cone-shaped firearm bolt assembly 310 of a repeating firearm system as described herein. According to some embodiments, the firearm bolt assembly 310 may comprise a bolt body 310-1, locking lugs 312, and a cone-shaped face 314. In some embodiments, the cone-shaped face 314 and/or the firearm bolt assembly 310 may comprise a cartridge channel 314-1. In some embodiments, the firearm bolt assembly 310 may comprise a cartridge seat 316, a firing pin hole 316-1, an extractor channel 318, an extractor 330, and/or an ejector 350.

According to some embodiments, any or all of the components 310-1, 312, 314, 314-1, 316, 316-1, 318, 330, 350 of the firearm bolt assembly 310 (and/or the firearm bolt assembly 310 itself) may be similar in configuration and/or functionality to any similarly named and/or numbered components described herein. Fewer or more components 310-1, 312, 314, 314-1, 316, 316-1, 318, 330, 350 (and/or portions thereof) and/or various configurations of the components 310-1, 312, 314, 314-1, 316, 316-1, 318, 330, 350 may be included in the firearm bolt assembly 310 without deviating from the scope of embodiments described herein. In some embodiments, one or more of the various components 310-1, 312, 314, 314-1, 316, 316-1, 318, 330, 350 may not be needed and/or desired in the firearm bolt assembly 310.

In some embodiments, the cartridge channel 314-1 may comprise a portion of the cone-shaped face 314 that is decreased in height. While a majority of the cone-shaped face 314 may comprise and/or defined a first height 360 from the cartridge seat 316, for example, the cartridge channel 314-1 may comprise and/or define a second height 362 that is smaller than the first height 360. In such a manner, for example, the rear of a cartridge (not shown) may be guided into the cartridge seat 316 and/or engage with the extractor 330 and/or the ejector 350. According to some embodiments, the ejector 350 may be configured to extend and/or protrude from the cartridge seat 316 by an amount equivalent to the second height 362. In such a manner, for example, the rear of a cartridge may be smoothly guided by cartridge channel 314-1 (e.g., from a magazine and/or clip, not shown) onto the protruding face of the ejector 350 and into the cartridge seat 316 to engage with the extractor 330. In some embodiments, the ejector 350 may comprise a rounded, chamfered, and/or tapered engaging end or tip (e.g., as depicted in FIG. 3). Such a specially-shaped ejector 350 (and/or portion thereof) may, for example, reduce jamming issues and/or otherwise facilitate smooth and/or reliable seating of the cartridge into the cartridge seat 316.

Figure 4:
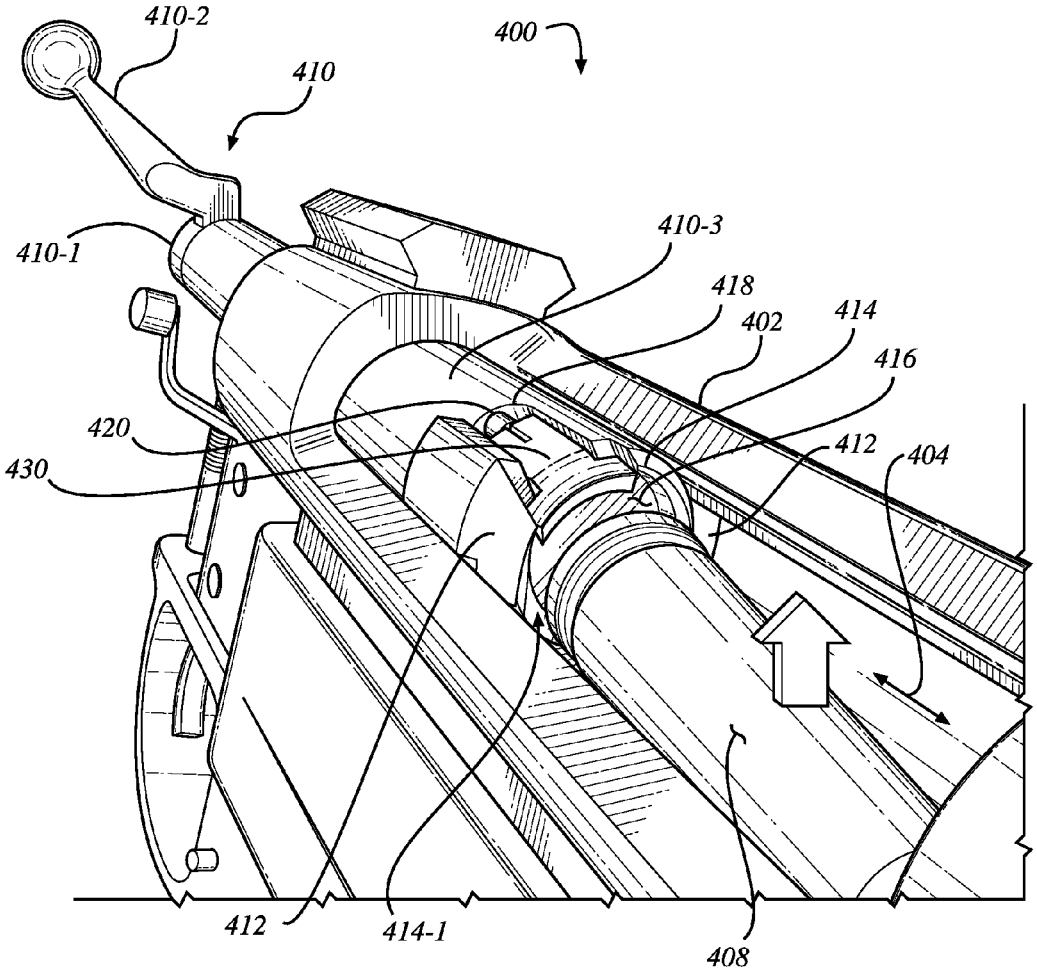
FIG. 4 is a perspective diagram of a firearm system according to some embodiments.

Referring to FIG. 4, for example, a perspective diagram of a firearm system 400 according to some embodiments is shown. In some embodiments, the firearm system 400 may comprise a receiver assembly 402 having a cutout and/or cavity defining an ejection port 404. The firearm system 400 may comprise a cartridge 408 and/or a bolt 410, either or both being disposed within the receiver assembly 402 and/or cavity defining the ejection port 404. As illustrated in FIG. 4, the cartridge 408 may enter the cutout and/or cavity defining the ejection port 404 from below (as depicted via the upward arrow), such as from a magazine and/or clip (not explicitly shown), to engage with the bolt 410. According to some embodiments, the bolt 410 may comprise an end collar 410-1, a bolt handle 410-2, a bolt body 410-3, one or more locking lugs 412, a tapered face 414, a cartridge guide 414-1, a cartridge seat 416, and/or an extractor channel 418. Disposed within the extractor channel 418, in some embodiments, may be an extractor plunger 420 and/or an extractor 430. For non-limiting purposes of illustration only, the wide-flanged extractor 430 depicted in FIG. 4 is a modified Sako®-style extractor. In some embodiments, other styles and/or configurations of extractors 430 (wide-flanged or otherwise) may be utilized.

The firearm system 400 may, for example, be similar to the firearm system 100 of FIG. 1 herein. According to some embodiments, any or all of the components 402, 404, 408, 410, 410-1, 410-2, 410-3, 412, 414, 414-1, 416, 418, 420, 430 of the firearm system 400 may be similar in configuration and/or functionality to any similarly named and/or numbered components described herein. Fewer or more components 402, 404, 408, 410, 410-1, 410-2, 410-3, 412, 414, 414-1, 416, 418, 420, 430 (and/or portions thereof) and/or various configurations of the components 402, 404, 408, 410, 410-1, 410-2, 410-3, 412, 414, 414-1, 416, 418, 420, 430 may be included in the firearm system 400 without deviating from the scope of embodiments described herein. In some embodiments, one or more of the various components 402, 404, 408, 410, 410-1, 410-2, 410-3, 412, 414, 414-1, 416, 418, 420, 430 may not be needed and/or desired in the firearm system 400.

In some embodiments, cartridge 408 may enter the cutout and/or cavity defining the ejection port 404 and be guided by the cartridge guide 414-1. The cartridge guide 414-1 may, for example, comprise and/or define a channel cut into the tapered face 414. In some embodiments, the cartridge guide 414-1 may be configured to accept the cartridge 408 from a particular direction, such as from below (e.g., from a magazine) as depicted in FIG. 4. According to some embodiments, the cartridge guide 414-1 may comprise a partial cut into the tapered face 414 such that the cartridge seat 416 maintains a lip and/or edge around the entire circumference of the tapered face 414. In such a manner, for example, the cartridge guide 414-1 may accept and/or facilitate reception of the cartridge 408, while the cartridge seat 416 remains configured to retain the cartridge 408 (or rear portion thereof), such as in conjunction with the extractor 430 and/or an ejector (not shown; but in the case of a plunger-style ejector, obscured by the rear of the cartridge 408 as it engages with the bolt 410, the cartridge guide 414-1, and/or the cartridge seat 416).

Figure 5:
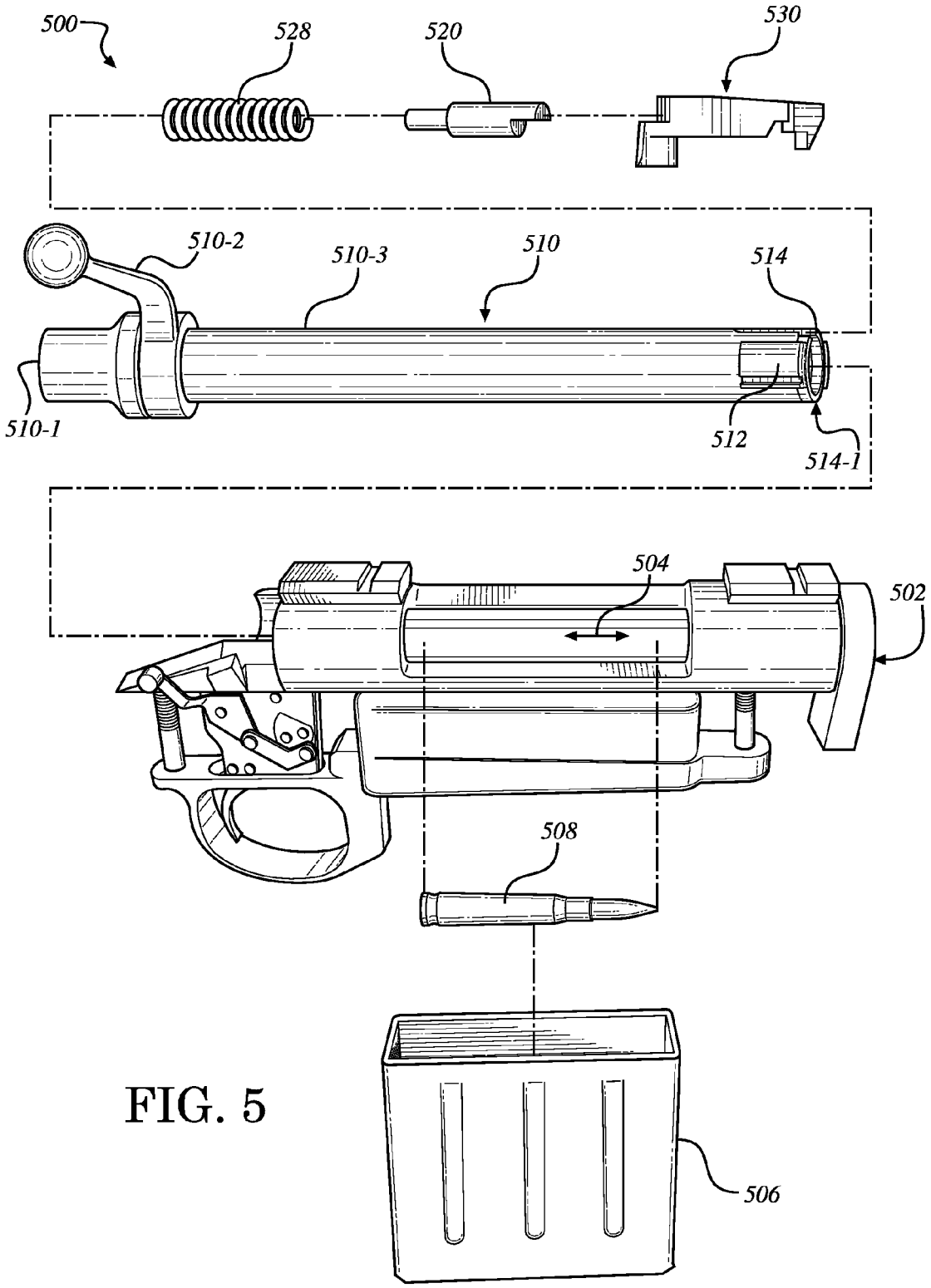
FIG. 5 is a perspective assembly diagram of a firearm system according to some embodiments.

Turning now to FIG. 5, a perspective assembly diagram of a firearm system 500 according to some embodiments is shown. As depicted for purposes of non-limiting illustration herein, the firearm system 500 comprises a receiver assembly 502 defining an ejection port 504, a magazine 506, an ammunition cartridge 508, a bolt 510 (comprising an end collar 510-1, a bolt handle 510-2, a bolt body 510-3, one or more retaining lugs 512, a cone-shaped face 514, and/or a cartridge channel 514-1), and a Sako®-style: extractor plunger 520, extractor spring 528, and extractor 530. In some embodiments, such as in the case that an AR-15/M-16-style extractor assembly is utilized, different, fewer, and/or more extractor assembly parts may be included in the firearm system 500, as is or becomes practicable and/or desirable. According to some embodiments, the extractor 530 may comprise a wide-flanged extractor and/or the bolt 510 may comprise a wide-flanged extractor channel, seat, and/or cut or cavity (not explicitly detailed in FIG. 5). In some embodiments, the According to some embodiments, any or all of the components 502, 504, 506, 508, 510, 510-1, 510-2, 510-3, 512, 514, 514-1, 520, 528, 530 of the firearm system 500 may be similar in configuration and/or functionality to any similarly named and/or numbered components described herein. Fewer or more components 502, 504, 506, 508, 510, 510-1, 510-2, 510-3, 512, 514, 514-1, 520, 528, 530 (and/or portions thereof) and/or various configurations of the components 502, 504, 506, 508, 510, 510-1, 510-2, 510-3, 512, 514, 514-1, 520, 528, 530 may be included in the firearm system 500 without deviating from the scope of embodiments described herein. In some embodiments, one or more of the various components 502, 504, 506, 508, 510, 510-1, 510-2, 510-3, 512, 514, 514-1, 520, 528, 530 may not be needed and/or desired in the firearm system 500.

While the firearm systems 100, 500 described with respect to FIG. 1 and/or FIG. 5 herein have generally been illustrated as bolt-action rifles, many other types of firearms and/or firearm systems may benefit from the utilization of a wide-flanged cartridge extractor as described in accordance with embodiments herein. A wide-flange extractor in accordance with some embodiments may, for example, be utilized in and/or with pistols, rifles, shotguns, cannons, artillery, and/or firearm types whether having bolt-actions, repeating actions, semi-automatic actions, and/or automatic actions. Similar, while the term "cartridge" has been utilized herein to refer to ammunition and/or ammunition casings extracted from a firearm system, an ammunition and/or ammunition casing type capable of being extracted utilizing a wide-flanged extractor as generally described herein is contemplated in some embodiments, despite the terminology utilized to describe such ammunition and/or ammunition casing types (e.g., artillery "shells").

Similarly, while both Sako®-style and AR-15/M-16-style extractors and extractor assemblies have been utilized for exemplary purposes herein, any other type and/or configuration of ammunition extractor that is or becomes known and may benefit from the wide-flanged modification(s) described herein may be utilized without deviating from the scope of some embodiments.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant currently intends to file additional applications to pursue patents for subject matter that has been disclosed and enabled but not claimed in the present application.

What is claimed is:

1. A firearm bolt assembly, comprising:

a cylindrically-shaped bolt body comprising a first end and a second end, with the second end comprising a tapered breech block face;

a first locking-lug extending radially outward from the cylindrically-shaped bolt body at the second end thereof and oriented at a first radial position along the circumference of the cylindrically-shaped bolt body;

a second locking-lug extending radially outward from the cylindrically-shaped bolt body at the second end thereof and oriented at a second radial position along the circumference of the cylindrically-shaped bolt body;

a circularly-shaped cartridge seat recessed into the tapered breech block face such that the tapered breech block face extends axially outward from the cartridge seat by a first distance corresponding to a first portion of the circumference of the circularly-shaped cartridge seat, the first portion being disposed between the first and second radial positions of the locking lugs on an upper region of the tapered breech block face; and a cartridge guide channel disposed within the tapered breech block face, the cartridge guide channel defining a portion of the tapered breech block face that extends axially outward from the cartridge seat by a second distance corresponding to a second portion of the circumference of the circularly-shaped cartridge seat, the second portion being disposed between the first and second radial positions of the locking lugs on an lower region of the tapered breech block face, wherein the second distance is less than the first distance.

2. The firearm bolt assembly of claim 1, further comprising:

a firing pin hole disposed in the cartridge seat.

3. The firearm bolt assembly of claim 2, further comprising:

a plunger-style ejector disposed within the cartridge seat.

4. The firearm bolt assembly of claim 3, further comprising:

an ejector spring coupled to exert a spring force on the plunger-style ejector.

5. The firearm bolt assembly of claim 3, wherein the plunger-style ejector comprises an ejector pin that is chamfered on an end disposed near the cartridge guide channel.

6. The firearm bolt assembly of claim 3, wherein the plunger-style ejector comprises an ejector pin that is rounded on an end disposed near the cartridge guide channel.

7. The firearm bolt assembly of claim 1, further comprising:

a wide-flanged cartridge extractor comprising a body and a wide-flanged head portion, the body of the wide-flanged extractor being seated in an extractor channel of the bolt body, and the wide-flanged head portion having a width that is wider than the body portion.

8. The firearm bolt assembly of claim 1, further comprising:

a firing pin assembly inserted into the bolt body from the first end.

9. The firearm bolt assembly of claim 1, further comprising:

a bolt handle coupled proximate to the first end of the bolt body.

* * * * *